US006237224B1

(12) United States Patent
Park

(10) Patent No.: US 6,237,224 B1
(45) Date of Patent: May 29, 2001

(54) NON-POWER TYPE OF HAIRS OF NOSTRILS CUTTER

(76) Inventor: Hojong Park, Jukong Apt., 1-401, Hwamyeong-dong, Buk-ku, Pusan 616-120 (KR)

( * ) Notice: Subject to any disclaimer, the term of this patent is extended or adjusted under 35 U.S.C. 154(b) by 0 days.

(21) Appl. No.: 09/424,379

(22) PCT Filed: Apr. 28, 1998

(86) PCT No.: PCT/KR98/00168

§ 371 Date: Nov. 23, 1999

§ 102(e) Date: Nov. 23, 1999

(87) PCT Pub. No.: WO98/57783

PCT Pub. Date: Dec. 23, 1998

(51) Int. Cl.[7] ..... B26B 19/00
(52) U.S. Cl. ..... 30/29.5
(58) Field of Search ..... 30/26, 29, 29.5, 30/363, 229, 178, 253; D28/60; 606/117, 172, 175, 176

(56) References Cited

U.S. PATENT DOCUMENTS

D. 286,091 * 10/1986 Hill ..... D28/60
865,551 * 9/1907 Wells ..... 30/178 X
1,178,323 * 4/1916 Knox ..... 30/178
4,092,776 * 6/1978 Ferguson ..... 30/253
5,052,258 * 10/1991 Hunter ..... 30/229 X

* cited by examiner

*Primary Examiner*—Douglas D. Watts
(74) *Attorney, Agent, or Firm*—Notaro & Michalos P.C.

(57) ABSTRACT

An unpowered nostril hair cutter includes: a first folding portion which is made by folding a steel plate having a good degree of elasticity and strength, at a center portion thereof in a downward direction thereof; handle portions which are formed to be opposite to each other centering around the first folding portion; second and third folding portions which are formed on the upper portions of the handle portions; a cutting ring having a hole which is formed to be integrated with the second folding portion of the one handle portion; and a circular cutting plate which is formed to be integrated with the third folding portion of the other handle portion and is passed through the hole to cut the nose hairs there between.

3 Claims, 3 Drawing Sheets

NON-POWER TYPE OF HAIRS OF NOSTRILS CUTTER

BACKGROUND OF THE INVENTION

1. Field of the Invention

The present invention relates to a non-power type of nose or nostril hair cutter.

2. Discussion of the Prior Art

The nostril hairs grow as time elapses, like the hairs appearing in some other parts of the human body. To keep the hair of the head neat, it should be cut periodically. Also, since the hairs under the arms or the hairs on the intimate parts of the body do not grow excessively due to friction against skin or clothes, they do not need to be cut separately and more particularly, can be shielded by the clothes.

However, since cutting of the hairs of the nostrils is not included within a basic charge in a barber's shop or a beauty salon, if there is he who wishes to have his own nose hairs cut, he should pay a separate cutting fee. If the separate fee is not paid, he should cut his nose hairs by himself. To this end, there have been presented an electric motor type of hairs of the nostrils cutter which is manufactured similarly to an electric razor and takes approximate fountain pen shape, in which a small battery is installed and a rotary type cutting edge is provided. However, it exhibits the following disadvantages; a malfunction occurs frequently; and the small battery should be exchanged within a proper time. Further, it generates several problems as follows; if it is not often cleaned, since a bad smell is generated from the cutter and bacteria are cultivated therein, it is used in an insanitary state; it is inconvenient to clean; and the cutting of the hairs of the nostrils is not well done. In other words, the hairs of the nostrils grow not in a straight state, but in an irregularly curved state. Also, they have a sharp ending part as the end of a needle and are relatively soft. In addition, since a viscous liquid of body fluids always exist within the nostrils along with nose runnings, the hairs of the nostrils can not be easily inserted into a minute hole which is formed on the net of the electric motor type of nostril hairs cutter. This results in deterioration of cutting efficiency and sanitariness. As a result, it is general that the hairs of the nostrils are cut with small scissors. However, there occur problems in that the removal of the hairs of the nostrils with the scissors is not safety and requires a relative long cutting time. Moreover, it provides some disadvantages in that it is used in an insanitary state and provides a bad appearance during used.

SUMMARY OF THE INVENTION

An object of the present invention is to provide a non-power type or unpowered of nostril or nose hairs cutter which is convenient and safe to be used and since it is operated in a non-power type manner, also does not generate a malfunction, such that it can ensure a semipermanent use.

Another object of the present invention is to provide a non-power type of hairs of the nostrils cutter which has the following advantages: cleaning is executed in an easy manner; because of a small size, it is portable in a simple manner; and it is operated in a sanitary state.

According to an aspect of the present invention, there is provided a non-power type of hairs of the nostrils cutter, including: a folding portion which is made by folding a steel plate having a good degree of elasticity and strength, at a center thereof and in a downward direction thereof; handle portions which are formed to be opposite to each other centering around the folding portion; a first circular cutting pipe which is welded on the top end of the one to handle portion and has a first inclined surface on an external edge thereof, the first inclined surface formed in an inward direction; and a second circular cutting pipe which is welded on the top end of the other handle portion and has a second inclined surface on an edge of the internal side thereof, the second inclined surface formed to be opposite to the first inclined surface, the second circular cutting pipe having a smaller outer diameter than the inner diameter of the first circular cutting pipe, wherein if the handle portions are closed by the force of a user's hand, the second circular cutting pipe is somewhat inserted into the first circular cutting pipe, so that the hairs of the nostrils placed between the first and second circular cutting pipes which are opposite are cut.

Preferably, the first and second circular cutting pipes can be replaced with third and fourth circular cutting pipes which each have an opening portion formed on the one side thereof.

According to another aspect of the present invention, there is provided a non-power type of hairs of the nostrils cutter, including a folding portion which is made by folding a steel plate having a good degree of elasticity and strength, at a center portion thereof and in a downward direction thereof; handle portions which are formed to be opposite to each other centering around the folding portion; a first cutting pipe which is welded on the top end of the one handle portion and has a first straight line portion on the lower portion thereof and a first circular pipe on the upper portion thereof; and a second cutting pipe which is welded on the top end of the other handle portion and has a second straight line portion on the lower portion thereof and a second circular pipe on the upper portion thereof.

According to still another aspect of the present invention, there is provided a non-power type of hairs of the nostrils cutter, including: a first folding portion which is made by folding a steel plate having a good degree of elasticity and strength, at a center portion thereof and in a downward direction thereof; handle portions which are formed to be opposite to each other centering around the first folding portion; second and third folding portions which are formed on the upper portions of the handle portions; a cutting ring having a hole which is formed to be integrated with the second folding portion of the one handle portion; and a circular cutting plate which is formed to be integrated with the third folding portion of the other handle portion and is passed through the hole.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENTS

Figure 1:
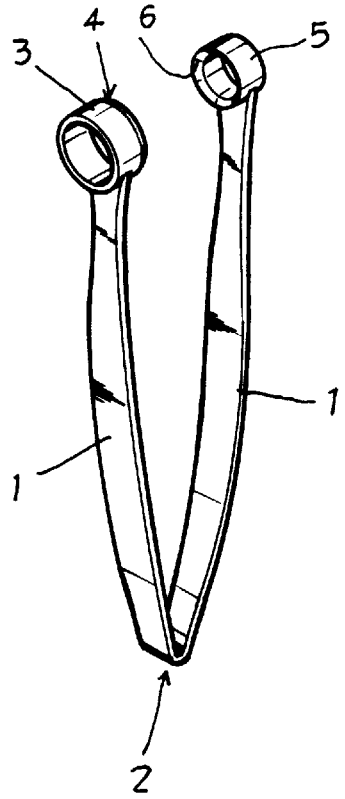
FIG. 1 is a perspective view illustrating a non-power type of hairs of the nostrils cutter embodied according to a first embodiment of the present invention.
Figure 2:
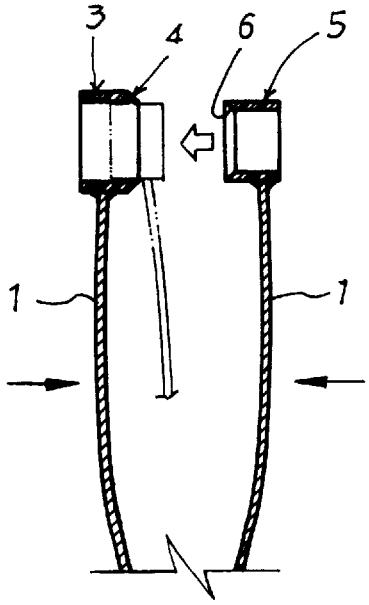
FIG. 2 is a sectional view of FIG. 1.

Hereinafter, an explanation on the construction and operation of the non-power type or unpowered nose or nostril hair cutter embodied according to the preferred embodiments of the present invention will be in detail discussed with reference to accompanying drawings. However, it should be noted that an explanation of parts necessary for the understanding of the present invention will be discussed hereinafter, and an explanation of parts except them will be excluded in this description for the sake of brevity.

In the first embodiment of the present invention, a non-power type of hairs of the nostrils cutter includes a folding portion 2 which is made by folding a steel plate having a good degree of elasticity and strength at a center portion thereof and in a downward direction thereof; handle portions 1 which are formed to be opposite to each other centering around the folding portion 2; a first circular cutting pipe 3 which is welded on the top end of the one handle portion 1 and has a first inclined surface 4 on an external edge thereof, the first inclined surface 4 formed in an inward direction; and a second circular cutting pipe 5 which is welded on the top end of the other handle portion 1 and has a second inclined surface 6 on an edge of the internal side thereof, the second inclined surface 6 formed to be opposite to the first inclined surface 4, the second circular cutting pipe 5 having a smaller outer diameter than the inner diameter of the first circular cutting pipe 3, wherein if the handle portions 1 are closed by the force of an operator's hand, the second circular cutting pipe is somewhat inserted into the first circular cutting pipe 3, so that the hairs of the nostrils placed between the first and second circular cutting pipes 3 and 5 which are opposite are cut.

Figure 3:
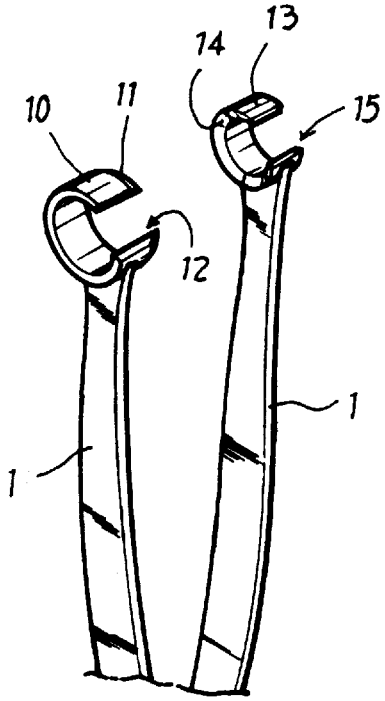
FIGS. 3 and 4 are perspective views each illustrating non-power type of hairs of the nostrils cutters embodied according to second and third embodiments of the present invention.
Figure 5:
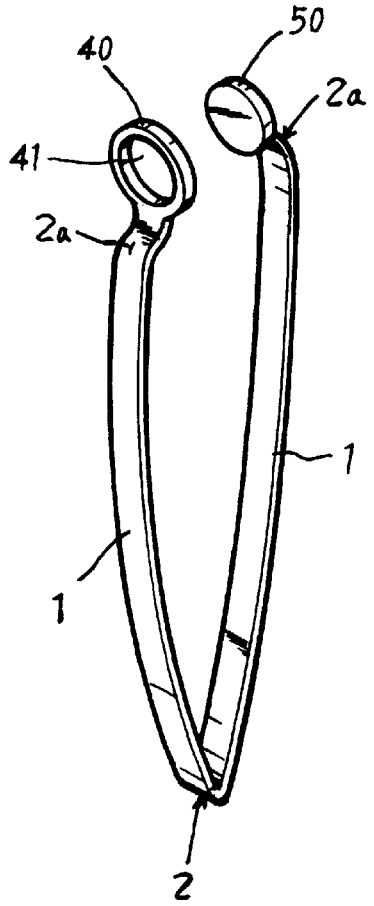
FIG. 5 is a perspective view illustrating a non-power type of hairs of the nostrils cutter embodied according to a fourth embodiment of the present invention.
Figure 6:
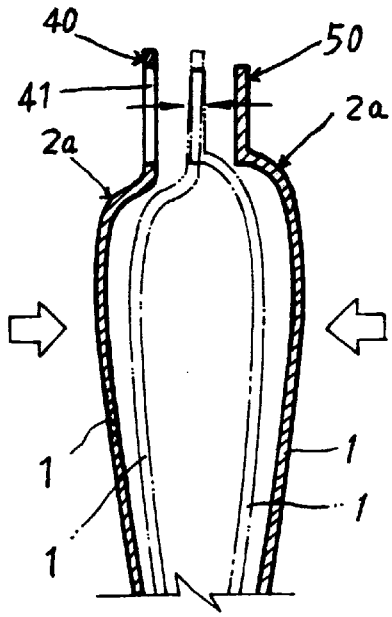
FIG. 6 is a sectional view of FIG. 5.

In operation, if the handling parting portions 1 are closed by the force of a user's hand, the second circular cutting pipe 5 is somewhat inserted into the first circular cutting pipe 3. At the time, it is desirable that a precise tolerance should be maintained between the first and second circular cutting pipes 3 and 5. When the first and second circular cutting pipes 3 and 5 are closely contacted and then inserted into the nostrils, the hairs of the nostrils are placed between the first and second circular cutting pipes 3 and 5. Therefore, when the second circular cutting pipe 5 is inserted into the first circular cutting pipe 3, the hairs of the nostrils are caught in the first circular cutting pipe 3 into which the second circular cutting pipe 5 is inserted. As a result, as if the steel plate is cut on a press, the hairs of the nostrils which are put between the first and second circular cutting pipes 3 and 5 can be cut in a simple manner. Then, most of the cut hairs of the nostrils remain within the first and second circular cutting pipes 3 and 5, such that after completion of the cutting, they can be easily removed. The cutting operation of the hairs of the nostrils embodied according to the second to fourth embodiments of the present invention can be executed in the same manner as that according to the first embodiment of the present invention. In the third embodiment of the present invention, first and second opening portions 12 and 15 as shown in FIG. 3 are formed in the now open cutting pipes 10 and 13 with their cutting edges 11 and 14, which provides a convenient cleaning advantage. In the fourth embodiment of the present invention, since a cutting ring 40 and a cutting plate 50 as shown in. FIG. 5 are designed to be tiny, they can be easy to be inserted into the nostrils. Accordingly, it is convenient to be used as well as is easy to be cleaned. Meanwhile, the steel plate used in the preferred embodiments of the present invention may be replaced with a stainless plate, which ensures the increment of durability thereof.

In FIG. 5 inward bends 2*a* are at the ends of handles 1,1 to move the cutting ring closer to the plate 50 in the open position of the device.

As clearly discussed above, a non-power type of hairs of the nostrils cutter embodied according to the principles of the present invention has excellent advantages in that since a cutting pipe itself takes a circular shape, danger generated during used can be prevented; and even if the hairs of the nostrils are curved and placed in irregular form, the first and second circular cutting pipes or the cutting ring and the cutting plate which are separated by a constant interval can serve to cut the hairs of the nostrils in an easy manner, without any problem. Furthermore, the non-power type of hairs of nostrils cutter according to the present invention is designed to have a small size, as pincers for pulling out hair, such that it is convenient to be portable. In addition, the non-power type of hairs of nostrils cutter according to the present invention includes the circular cutting pipe in which a hole is formed, such that the cut hairs of the nostrils can be all removed in an easy manner and even in the state where nose runnings or a viscous liquid of body fluids remain on the circular cutting pipe, it is easy to be cleaned. Moreover, the non-power type of hairs of nostrils cutter according to the present invention is constructed to have a soft appearance, such that it is safe during used as well as takes a good shape. Finally, the non-power type of hairs of nostrils cutter according to the present invention is manufactured in a simple manner, so that a cutting efficiency is high, while the production cost is low.

Figure 4:
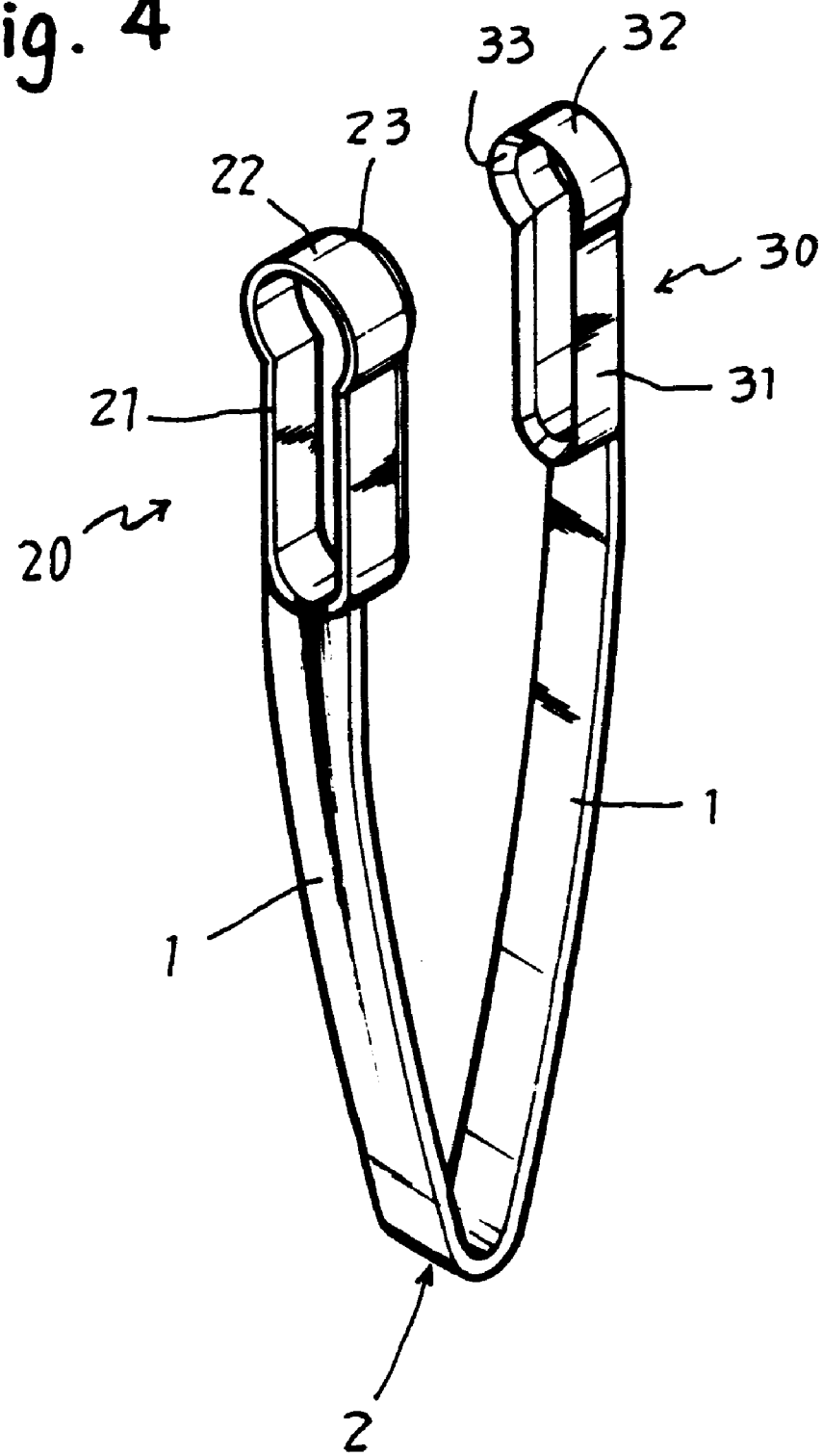

FIG. 4 shows a case where cutting members 20, 30 have cutting pipes 22, 32 with cutting edges 23, 33 and elongated openings 21, 31 also with cutting edges.

Although a preferred form of the invention has been described, it will be understood by those skilled in the field that variations therefrom, and, analogous uses, are within the knowledge of those skilled in the art. Accordingly, it is intended that the scope of the invention be defined, not by the scope of the foregoing description, but rather by the scope of the claims as interpreted in view of the pertinent prior art.

What is claimed is:

1. An unpowered nostril hair cutter, comprising:

a first folded portion made of steel plate having sufficient elasticity and strength to allow the folded portion to bend;

a pair of handle portions each connected to one end of the first folded portion, the handle portions being opposite to each other and movable toward and away from each other by bending of the first folded portion, each handle portion having an outer end remote from the first folded portion;

a first circular cutting pipe connected to the outer end of one of the handle portions, the first circular cutting pipe having a first inclined surface on an edge thereof facing the other handle portion and defining a first cutting edge;

a second circular cutting pipe connected to the outer end of the other handle portion, the second circular cutting pipe having a second inclined surface on an edge facing the first mentioned handle portion and aligned with the first circular cutting pipe, defining a second cutting edge, the second circular cutting pipe having a diameter which is smaller than the first circular pipe so that when the handle portions are moved toward each other, the second circular cutting pipe slides at least partly into the first circular cutting pipe for cutting any nostril hairs between the first and second inclined surfaces; and each of the first and second circular cutting pipes including an elongated portion with each elongated portion including portions of the first and second inclined surfaces for cutting additional nostril hairs that may be between the elongated portions when the handled portions are moved toward each other to engage the elongated portions with each other.

2. An unpowered nostril hair cutter, comprising:

a first folded portion made of steel plate having sufficient elasticity and strength to allow the folded portion to bend;

a pair of handle portions each connected to one end of the first folded portion, the handle portions being opposite to each other and movable toward and away from each other by bending of the first folded portion, each handle portion having an outer end remote from the first folded portion;

a circular cutting pipe connected to the outer end of one of the handle portions, the circular cutting pipe having a first inclined surface on an edge thereof facing the other handle portion and defining a first cutting edge;

a circular cutting plate connected to the outer end of the other handle portion, the circular cutting plate having an outer second cutting edge aligned with the first cutting edge, the circular cutting plate having a diameter which is smaller than the circular pipe so that when the handle portions are moved toward each other, the circular cutting plate slides into the circular cutting pipe for cutting any nostril hairs between the first and second cutting edges.

3. A cutter according to claim 2 wherein each of the handle portions include second folded portions near the outer ends of the handle portions which bring the circular cutting pipe closer to the circular cutting plate.

* * * * *